US006425705B1

(12) United States Patent
Ingram

(10) Patent No.: US 6,425,705 B1
(45) Date of Patent: Jul. 30, 2002

(54) RATCHET MECHANISM FOR CONNECTING A CLEANING HEAD TO A HANDLE

(75) Inventor: Vicki Ingram, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 09/836,930

(22) Filed: Apr. 18, 2001

(51) Int. Cl.[7] ..... A46B 11/00

(52) U.S. Cl. ..... 401/290; 401/268; 15/145; 15/143.1; 15/176.1; 15/176.6; 15/176.3

(58) Field of Search ..... 401/290, 268; 403/299, 315, 316, 317, 320, 287; 15/145, 143.1, 176.1, 176.2, 176.3, 176.4, 176.5, 176.6; 16/422, 427; 285/81, 90

(56) References Cited

U.S. PATENT DOCUMENTS

| | | | | |
|---|---|---|---|---|
| 371,515 | A | | 10/1887 | Nowotny |
| 854,151 | A | | 5/1907 | Deasy |
| 1,147,332 | A | | 7/1915 | McNeill et al. |
| 1,903,896 | A | | 4/1933 | Greenberg |
| 2,815,989 | A | | 12/1957 | McCrink |
| 2,975,463 | A | | 3/1961 | Morris |
| 3,183,540 | A | | 5/1965 | McCrink |
| 3,989,390 | A | | 11/1976 | Thorner |
| 4,136,419 | A | | 1/1979 | Hetman et al. |
| 4,185,937 | A | * | 1/1980 | Anderson ..... 401/316 |
| 4,684,283 | A | * | 8/1987 | Lewis, Jr. ..... 403/299 |
| 4,778,298 | A | | 10/1988 | Shin et al. |
| 4,933,016 | A | | 6/1990 | Carlson |
| 5,161,278 | A | | 11/1992 | Tomm |
| 5,172,447 | A | | 12/1992 | Tomm |
| 5,215,336 | A | * | 6/1993 | Worthing ..... 285/81 |
| 5,274,872 | A | | 1/1994 | Rich |
| 5,414,889 | A | | 5/1995 | Sartori |
| 5,924,816 | A | | 7/1999 | Schuele |
| 5,964,005 | A | | 10/1999 | Williams et al. |
| 5,988,912 | A | | 11/1999 | Chen |

* cited by examiner

*Primary Examiner*—David J. Walczak
(74) *Attorney, Agent, or Firm*—Hovey Williams LLP

(57) ABSTRACT

A ratchet-like coupling mechanism (20) for releaseably coupling a cleaning head (22) to a handle (24). The mechanism (20) comprises a handle adaptor (28); a sleeve (30); an engagement arm (32); and an engagement wheel (34). Where a liquid delivering handle (24) is used, the handle adaptor (28) operates to adapt the mechanism (20) to avoid interfering with the liquid flowpath. The handle adaptor (28) may be eliminated where a solid handle is used. The sleeve (30) secures to the handle adaptor (28) or directly to the handle, and supports the engagement arm (32). The engagement wheel (34) is secured to the head (22). The arm (32) and wheel (34) present oppositely biased teeth (56,57) allowing the adaptor (28) or handle to be threadably coupled with the head (22), but which must be disengaged, by actuating the arm (32), to uncouple the head (22) from the handle (24).

11 Claims, 4 Drawing Sheets

RATCHET MECHANISM FOR CONNECTING A CLEANING HEAD TO A HANDLE

RELATED APPLICATIONS

This application is related to copending patent application entitled "Wash Brush System With Removable Head", Ser. No. 09/837,088, filed Apr. 18, 2001, which is hereby incorporated by reference into the present application.

BACKGROUND OF THE INVENTION

1. Field of the Invention

The present invention relates to handled cleaning tools having separate cleaning heads and handles that may be coupled for use and uncoupled, as desired, for storage, maintenance, or replacement. More particularly, the invention relates to a ratchet-like coupling mechanism for releasably coupling, using directionally interlocking teeth, a cleaning head, such as a broom, mop, or sponge head, to a handle.

2. Description of the Prior Art

Brushes, brooms, and similar cleaning tools have long been used to sweep, scrub, mop, or otherwise clean surfaces or objects as needed. Typically, these tools comprise a cleaning head and a handle, with the head presenting a cleaning material of some sort, such as bristles, a scrubbing pad, or an absorbent material. Further, the head is typically removably coupled with the handle so as to allow for storage, maintenance, and replacement of dirty or worn heads, or changing to a different handle having some desired characteristic such as a longer or shorter length.

Those with ordinary skill in the mechanical arts will appreciate that numerous mechanisms exist for coupling a cleaning head with a handle. Perhaps the most well known mechanism involves providing the head with a threaded recess and the handle with a threaded end so that the two may be screwed together. Unfortunately, the threads often strip due to overtightening, or the handle inadvertently unscrews during use. When this happens, it is known, for example, to glue or nail the head and handle together. Unfortunately, doing so effectively eliminates any ability to uncouple the members when desired.

Other coupling mechanisms are known that employ complicated and expensive interlocking members secured to or incorporated into one or both of the head or handle. The complexity of these latter mechanisms makes them prone to wear and breakage, and can substantially increase the cost of the tool. Still another category of coupling mechanisms exists that relies on points or teeth to bitingly engage the handle or head. These mechanisms can cause degradation over time of the handle material, particularly wood or plastic, or make uncoupling difficult.

Due to the above-identified and other problems in the art, a need exists for a cleaning tool having an improved coupling mechanism for securely coupling cleaning head to handle.

SUMMARY OF THE INVENTION

The coupling mechanism of the present invention overcomes the above-identified and other problems in the art by providing a simple and inexpensive ratchet-like mechanism for securely coupling a cleaning head to a handle and preventing inadvertent uncoupling, while allowing for quick and easy uncoupling when desired.

The preferred mechanism comprises a handle adaptor; a sleeve; an engagement arm; and an engagement wheel. The handle adaptor is an adaptation for accommodating a handle operable to deliver a liquid, wherein inclusion of the handle adaptor avoids interfering with a liquid flowpath through the handle and head. The handle adaptor may be eliminated in many applications, particularly where a solid handle is used. The sleeve secures to the handle adaptor or directly to the handle, and supports the engagement arm. The engagement wheel is secured to or incorporated into the cleaning head. The arm and wheel present oppositely slanted or biased teeth that directionally interlock depending on the direction of relative motion.

In operation, the sleeve is coupled either with the adaptor or directly with the handle. The adaptor or handle is then screwed into a threaded head recess at least until first teeth of the engagement arm operatively contact second teeth of the engagement wheel. The slanted biases of the teeth allow the adaptor or handle to be screwed into the head without interference, but prevent it from being inadvertently removed therefrom.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
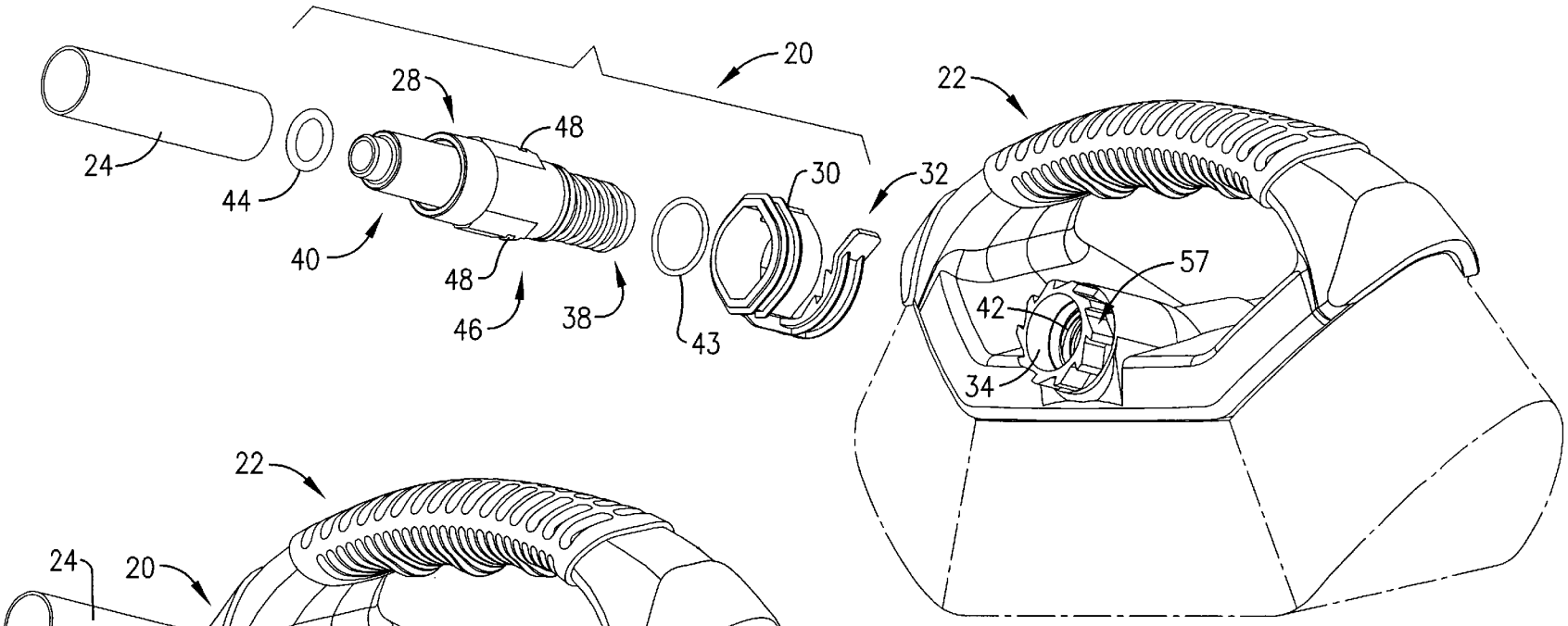
FIG. 1 is an exploded view of a preferred embodiment of the coupling mechanism of the present invention shown with a cleaning tool comprising a cleaning head and a handle.
Figure 2:
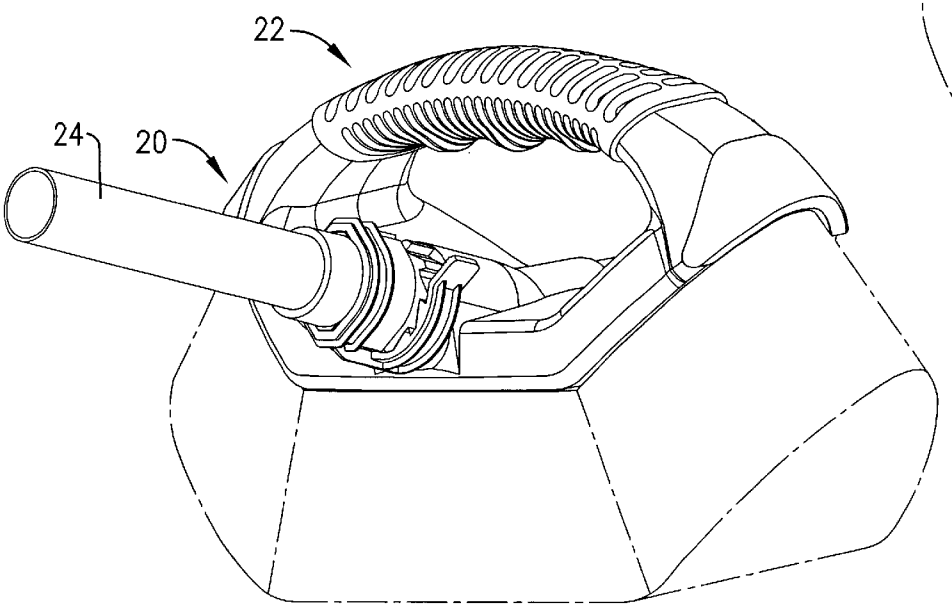
FIG. 2 is an isometric view showing the assembled cleaning tool of FIG. 1 with the coupling mechanism engaged.
Figure 3:
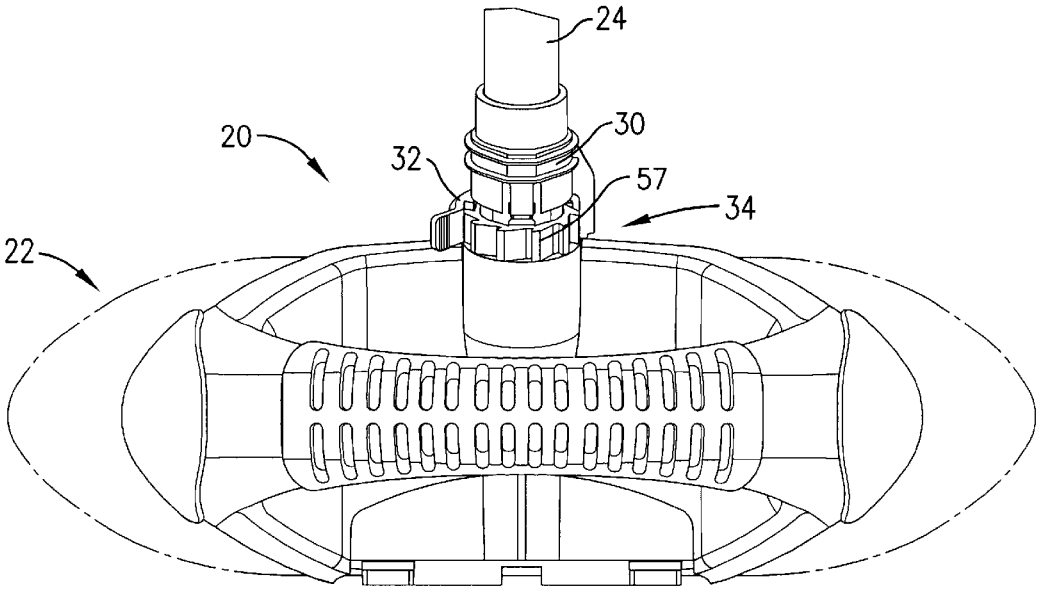
FIG. 3 is a top plan view of the cleaning tool of FIG. 2.
Figure 4:
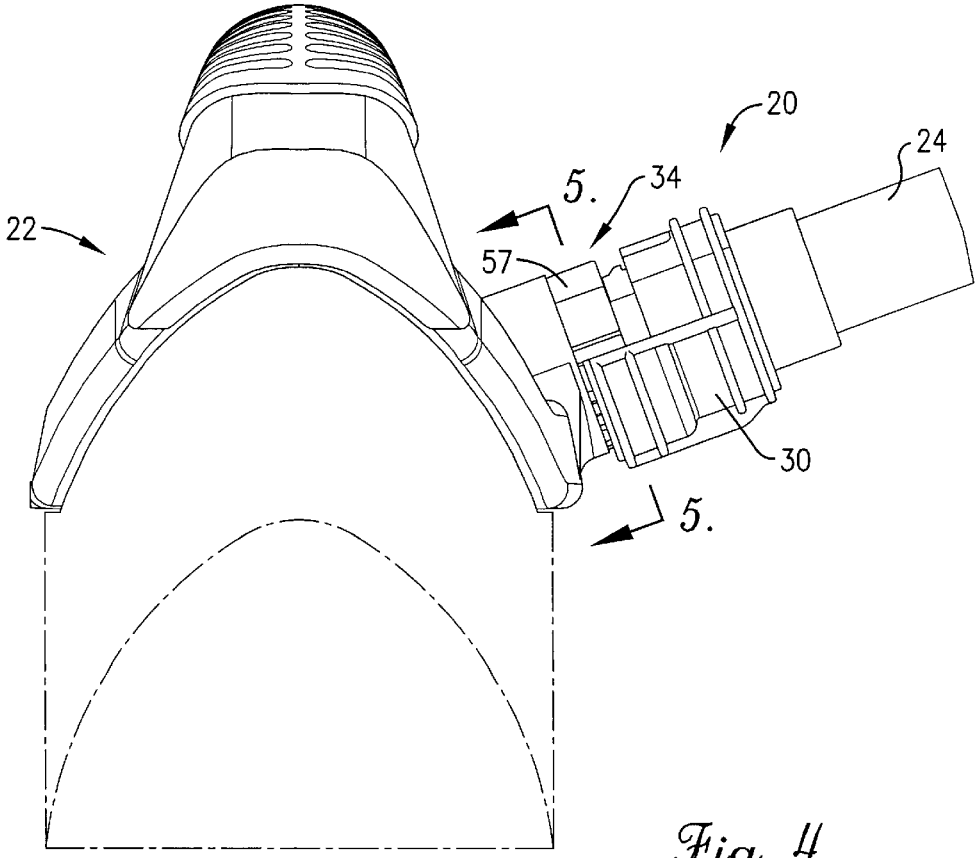
FIG. 4 is a left side elevational view of the cleaning tool of FIG. 2.
Figure 6:
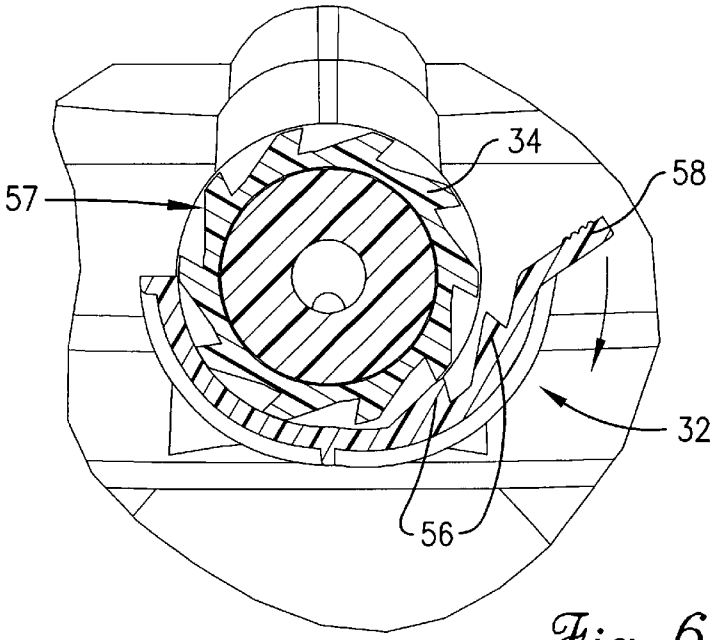
FIG. 6 is a fragmentary sectional view of the disengaged coupling mechanism.
Figure 5:
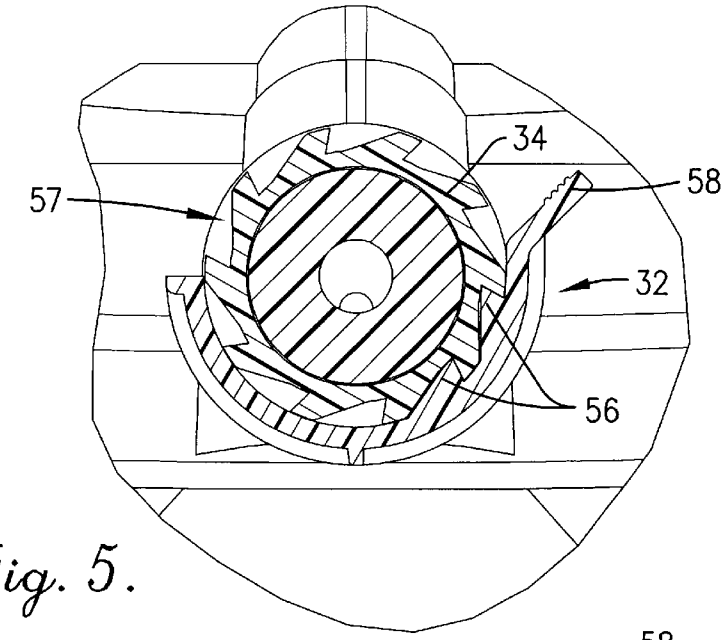
FIG. 5 is a fragmentary sectional view of the engaged coupling mechanism.

Referring to FIGS. 1, 2, 3, and 4, the present invention is a ratchet-like coupling mechanism 20 for securely coupling a cleaning head 22 to a handle 24. A preferred embodiment of the coupling mechanism 20 is illustrated herein as being adapted for use with a wash brush having an internal flowpath operable to deliver a liquid at the cleaning head 22, such as the wash brush disclosed and claimed in the copending patent application titled "Wash Brush System With Removable Head", Ser. No. 09/837,088, filed Apr. 18, 2001. As will be appreciated by those with skill in the mechanical arts, however, the coupling mechanism 20 may be easily configured or adapted for other applications, and is therefore not limited to the embodiment disclosed herein for illustrative purposes only. The illustrated coupling mechanism 20 broadly comprises a handle adaptor 28; a sleeve 30; an engagement arm 32; and an engagement wheel 34. Except where otherwise noted, mechanism components may be constructed of plastic, metal, or any other suitable material.

As is disclosed in the above identified co-pending application, the handle 24 is an elongated hollow cylinder having an internal first flowpath for delivering a liquid to the cleaning head 22. The head 22 provides a second flowpath alignable with the first when the handle 24 and head 22 are properly coupled. Thus, in this particular embodiment, it is desirable that the coupling mechanism 20 securely couple the head 22 with the handle 24 without obstructing either flowpath.

The handle adaptor 28 is included to adapt the coupling mechanism 20 so as to accommodate the flowpaths, and comprises a substantially hollow cylinder having first and second ends 38,40. The first end 38 is externally threaded and corresponds to an internally threaded threaded recess 42 presented by the head 22. An O-ring 43 or gasket may be slipped over the first end 38 to prevent leakage of any liquid from the flowpath. The second end 40 is sized to fit tightly within the hollow handle 24. An O-ring 44 or gasket may be slipped over the second adaptor end 40 to prevent leakage of any liquid flowing from the flowpath. Midway between the first and second ends 38,40, the adaptor 28 includes an elliptical connector portion 46 presenting female recesses 48 of any suitable shape, such as square, rectangular, or round.

As will be appreciated by one with skill in the mechanical arts, the handle adaptor 28 is an adaptation for accommodating the first and second flowpaths of the head 22 and handle 24, and is unnecessary in applications not involving such. For example, were the coupling mechanism 20 is to be used on a conventional wooden pushbroom with a solid, threaded handle, the handle adaptor 28 is not required and may be eliminated.

Figure 8:
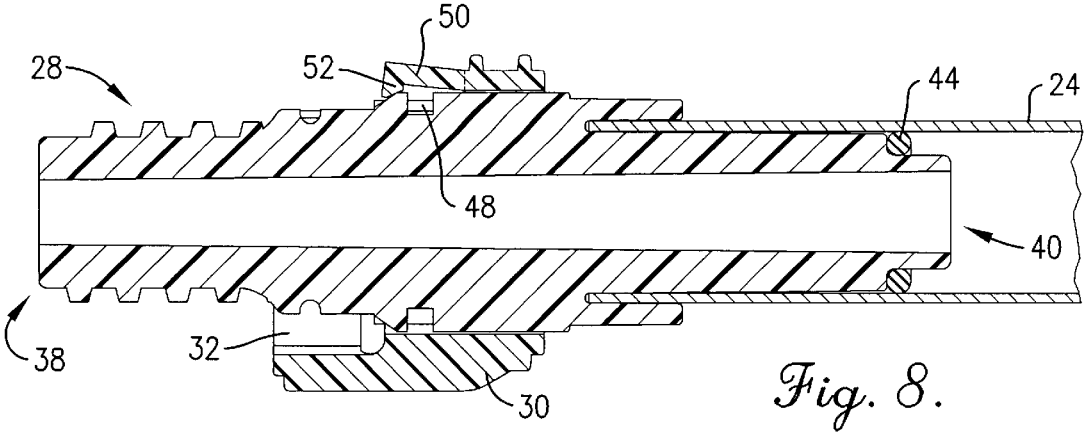
FIG. 8 is a fragmentary sectional view taken along line 8—8 of FIG. 7 and showing the coupling mechanism being installed on the handle.
Figure 9:
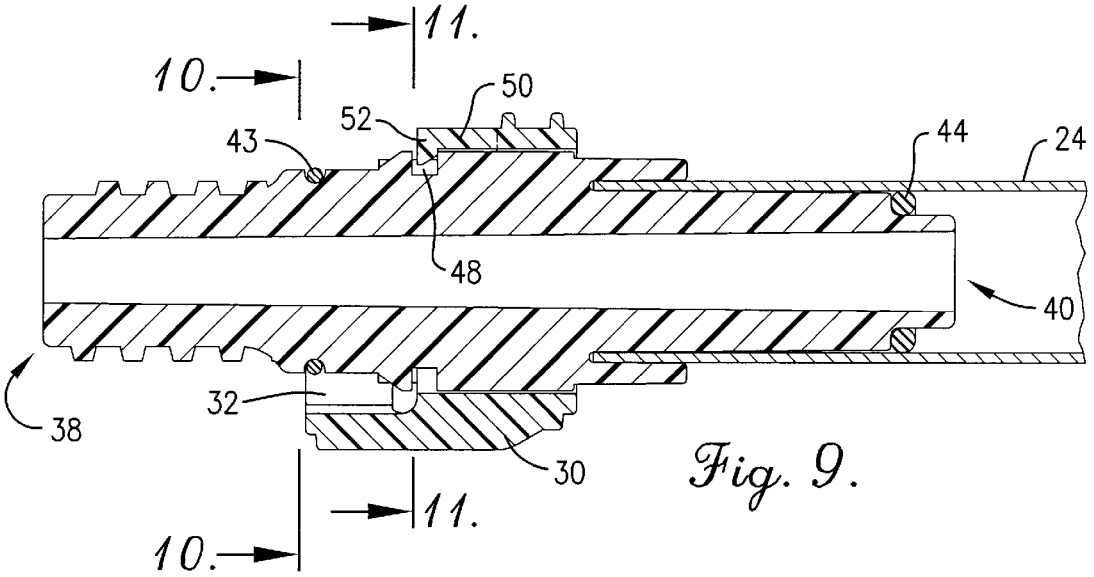
FIG. 9 is a fragmentary sectional view taken along line 8—8 of FIG. 7 showing the coupling mechanism properly installed on the handle.
Figure 10:
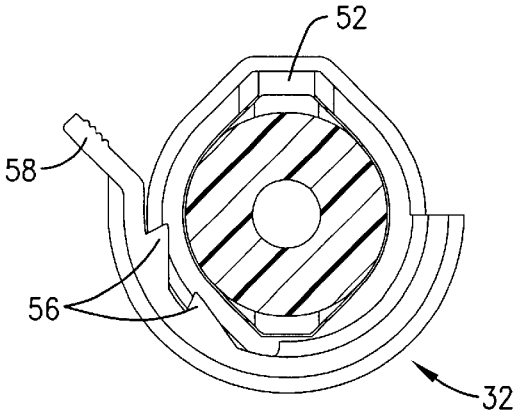
FIG. 10 is a sectional view taken along line 10—10 of FIG. 9.
Figure 11:
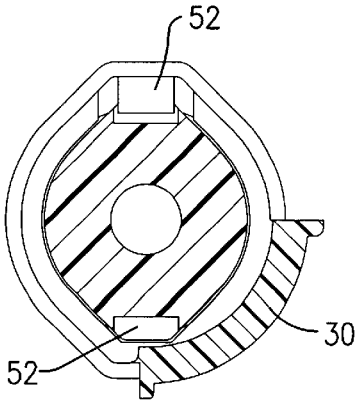
FIG. 11 is a sectional view taken along line 11—11 of FIG. 9.

The sleeve 30 supports and couples the engagement arm 32 with the adaptor 28 or the handle 24. The sleeve's shape corresponds to the elliptical connector portion 46 of the handle adaptor 28. Referring also to FIGS. 8 and 9, the sleeve 30 comprises two or more semi-flexible tabs 50 having inwardly projecting catches 52 corresponding to the female recesses 48 of the adaptor 28 such that the catches 52, when the sleeve 30 is properly positioned upon the adaptor 28, engage the female recesses 48 to secure the sleeve 30 in its operative location.

As noted above, the described preferred embodiment includes adaptations for a particular application involving a wash brush. Where the present invention is to be used with an ordinary solid handled cleaning tool, the handle adaptor 28 may be eliminated and the sleeve 30 coupled directly with the handle. In this case, a number of mechanisms and schemes may be used to secure the sleeve 30 directly to the handle, including commonly available fasteners such as nails or screws.

Referring also to FIGS. 5, 6, 10, and 11, the engagement arm 32 is hingedly or flexibly coupled with the sleeve 30 to project therefrom, and presents a plurality of first teeth 56 slantedly biased in a first direction and operable to directionally interlock with and selectively engage the engagement wheel 34 and prevent relative movement therebetween. Although two or three first teeth are preferred, the number of first teeth 56 presented is a matter of design choice and application. The engagement arm 32 also presents a projecting tang 58 which facilitates actuating the arm 32 to release the engaged teeth 56 and thereby permit removal of the handle 24 from the head 22.

The engagement wheel 34 is a cylindrical wheel secured to or incorporated into the head 22 of the wash brush or other cleaning tool and presenting a plurality of second teeth 57 arranged about an outer surface of the wheel 34 and slantedly biased in a second direction opposite the first direction of the first teeth 56 so as to directionally interlock with and selectively engage the first teeth 56 and prevent relative movement therebetween. The size and shape of the second teeth 57 should correspond with those of the first teeth 56; the number of second teeth 57 presented is a matter of design choice and application. The engagement wheel 34 has a hollow center so to allow the threaded second adaptor end 38 or, in other embodiments, the threaded handle end to pass into the head recess 42 wherein it may be threadably engaged.

In operation, the handle adaptor 28 is first properly installed within the handle 24 and the engagement wheel 34 is properly located upon the head 22. Installation of the adaptor 28 involves installing the O-rings 43,44 and pushing the second adaptor end 40 into the handle 24 until snuggly fit therein. The engagement wheel 34 may be incorporated into the head 22 during manufacture, or may require installation involving, for example, positioning the wheel 34 over the internally threaded recess 42 and securing it with suitable fasteners, such as nails or screws.

Figure 7:
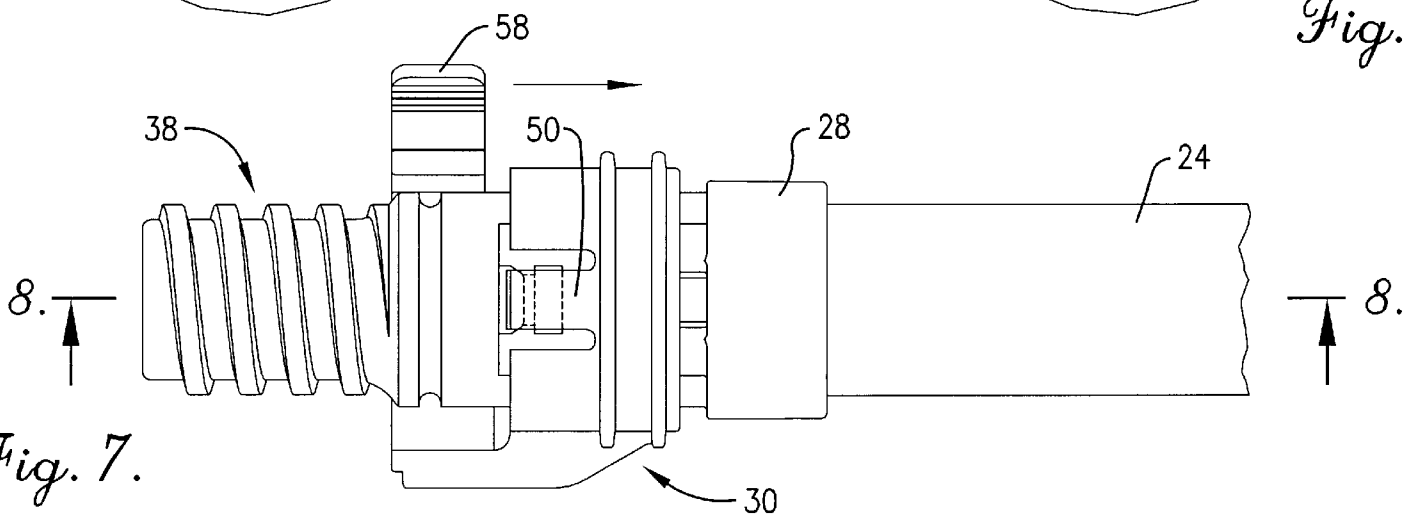
FIG. 7 is a fragmentary view of the coupling mechanism showing its relationship with the handle.

The sleeve 30 is then slipped over the externally threaded first adaptor end 38, as shown in FIG. 7, and pushed onto the elliptical portion 46 until the catches 52 engage the female recesses 48. The threaded adaptor end 38 is then screwed into the head recess 42 at least until the first teeth 56 of the engagement arm 32 operatively contact the second teeth 57 of the engagement wheel 34. The slanted biases of the teeth 56,57 allow the adaptor 28 to be screwed into the head 22 without interference, but prevent it from being inadvertently removed therefrom.

When it is desired to uncouple the head 22 from the handle 24, the engagement arm 32 must be actuated to disengage the teeth 56,57 and allow the adaptor 28 or handle to be unscrewed. The arm 32 may be so actuated by pulling upon the tang 58 until the teeth 56,57 are separated.

From the preceding description, it can be seen that the ratchet-like coupling mechanism 20 of the present invention provides a simple and inexpensive releasable mechanism for securely coupling a cleaning head to a handle and preventing inadvertent uncoupling, while allowing for quick and easy uncoupling when desired.

Although the invention has been described with reference to the preferred embodiment illustrated in the attached drawings, it is noted that equivalents may be employed and substitutions made herein without departing from the scope of the invention as recited in the claims. For example, as described above, the handle adaptor 28 is an adaptation for accommodating flowpaths within the hollow handle 24 and head 22, and may be eliminated where the handle is solid or otherwise provides a surface or mechanism to which or with which the sleeve 30 may be secured.

Having thus described the preferred embodiment of the invention, what is claimed as new and desired to be protected by Letters Patent includes the following:

1. A cleaning tool comprising:

a handle having an elongated body presenting an externally threaded end;

a cleaning head presenting an internally threaded recessed portion;

a sleeve operable to couple with the handle at the externally threaded end;

an engagement arm actuatably coupled with the sleeve and presenting one or more first teeth; and an engagement wheel having a hollow center and presenting one or more second teeth arranged circumferentially about an outer surface of the engagement wheel, with the engagement wheel being secured over the internally threaded recessed portion of the cleaning head so as to allow the externally threaded end of the handle to be received within the internally threaded recessed portion;

wherein the first and second teeth are oriented so as to slide over one another when the engagement arm and the engagement wheel are rotated relative to one another in a tightening direction, and to engage one another when the engagement arm and the engagement wheel are rotated relative to one another in a loosening direction.

2. The cleaning tool as set forth in claim 1, wherein the engagement wheel is secured to the cleaning head.

3. The cleaning tool as set forth in claim 1, wherein the engagement wheel is incorporated into the cleaning head.

4. The cleaning tool as set forth in claim 1, wherein the engagement arm presents a tang operable to facilitate actuation of the engagement arm.

5. A cleaning tool comprising:

a handle having an elongated hollow body;

a cleaning head presenting an internally threaded recessed portion;

a handle adaptor presenting first and second ends, with the first end operable to couple with the handle and the second being externally threaded and operable to be received within the internally threaded recessed portion of the cleaning head;

a sleeve operable to couple with the handle adaptor;

an engagement arm actuatably coupled with the sleeve and presenting one or more first teeth; and an engagement wheel having a hollow center and presenting one or more second teeth arranged circumferentially about an outer surface of the engagement wheel, with the engagement wheel being secured over the internally threaded recessed portion of the cleaning head so as to allow the externally threaded end of the handle adaptor to be received within the internally threaded recessed portion;

wherein the first and second teeth are oriented so as to slide over one another when the engagement arm and the engagement wheel are rotated relative to one another in a tightening direction, and to engage one another when the engagement arm and the engagement wheel are rotated relative to one another in a loosening direction.

6. The cleaning tool as set forth in claim 5, wherein the engagement wheel is secured to the cleaning head.

7. The cleaning tool as set forth in claim 5, wherein the engagement wheel is incorporated into the cleaning head.

8. The cleaning tool as set forth in claim 5, wherein the engagement arm presents a tang operable to facilitate actuation of the engagement arm.

9. The cleaning tool as set forth in claim 5, wherein the first end of the handle adaptor couples with the handle by fitting snuggly inside the elongated hollow body.

10. The cleaning tool as set forth in claim 5, wherein the coupled handle and head provide an internal liquid flowpath extending through the cleaning tool, and the handle adaptor is hollow to accommodate the flowpath.

11. The cleaning tool as set forth in claim 10, further comprising an O-ring associated with the handle adaptor to prevent leakage of a liquid flowing in the flowpath.

* * * * *